United States Patent [19]

Nigh

[11] Patent Number: 4,989,879

[45] Date of Patent: Feb. 5, 1991

[54] FOOTBALL BOARD GAME

[76] Inventor: James L. Nigh, 5321 W. 76 Ave., Apt. #306, Arvada, Colo. 80003

[21] Appl. No.: 519,804

[22] Filed: May 7, 1990

[51] Int. Cl.[5] ..... A63F 3/00

[52] U.S. Cl. ..... 273/247; 273/94; 273/146

[58] Field of Search ..... 273/247, 94, 146

[56] References Cited

U.S. PATENT DOCUMENTS

| | | | |
|---|---|---|---|
| 1,562,866 | 11/1925 | Burgess | 273/94 |
| 1,614,881 | 1/1927 | Conley | 273/94 |
| 1,747,065 | 2/1930 | Elliott | 273/94 |
| 4,203,605 | 5/1980 | Moody | 273/247 |
| 4,524,975 | 6/1986 | Coughie et al. | 273/247 |

*Primary Examiner*—Benjamin Layno
*Attorney, Agent, or Firm*—Leon Gilden

[57] ABSTRACT

A board game simulating football play is set forth, wherein a rigid planar board supports a playing field demarcated in representative one hundred yard simulation defining a first and second end zone at opposed first and second ends of the playing field, with spaced first and second side line borders including slots for receiving slidable yardage markers therewithin. Each player is provided a container including a matrix of compartments therewithin to receive plural pairs of dice. The dice include three pairs of dice, each of various numerations for use in simulating advance along the playing field by an offensive team, with further plural pairs of dice selectively utilized by an opposing player for simulating defensive yardage gains against an opponent. Further, plural pairs of dice are provided for use in simulating field goals, kick-offs, and punt returns. A timing mechanism is provided for simulating four quarters of a representative game, wherein a highest score attained by a player defines a winner in play of the game apparatus.

5 Claims, 5 Drawing Sheets

FIG. 14
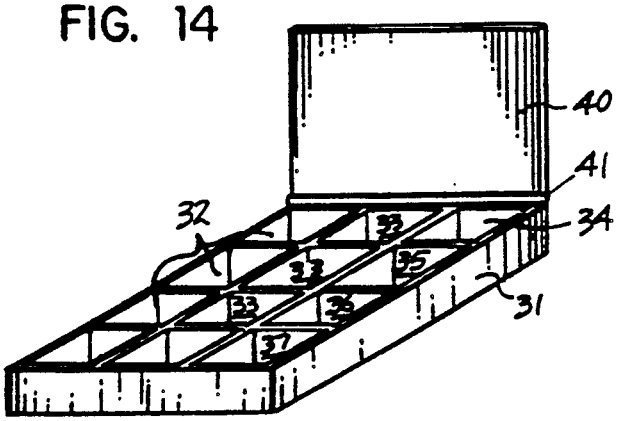
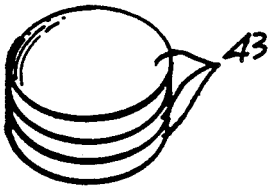
FIG. 17
FIG. 15
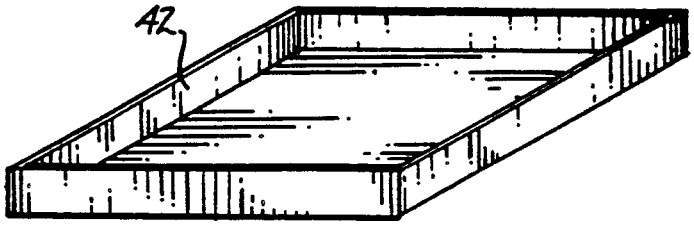
FIG. 16
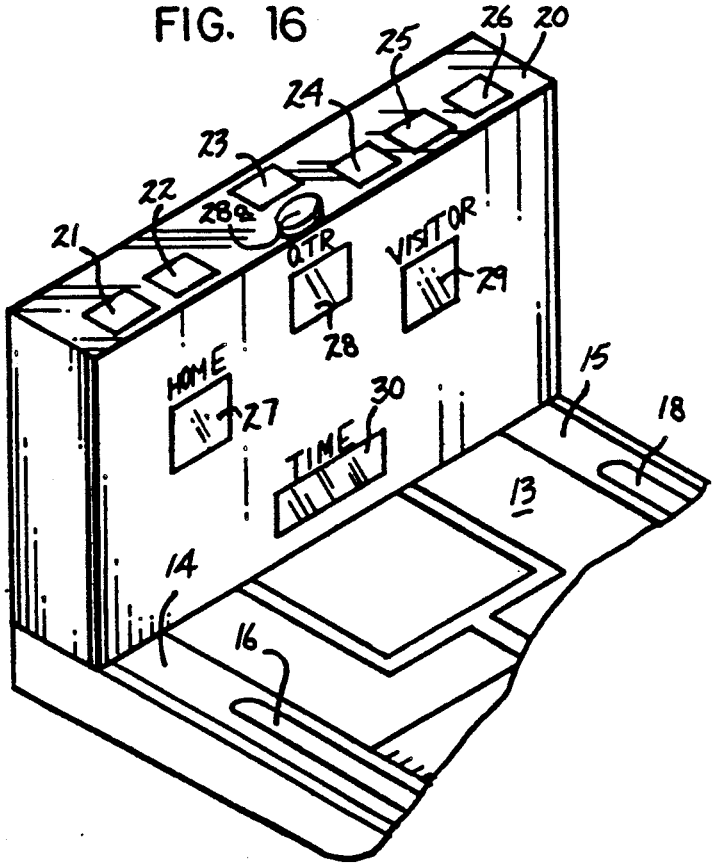

FOOTBALL BOARD GAME

BACKGROUND OF THE INVENTION

1. Field of the Invention

The field of invention relates to board games, and more paricularly pertains to a new and improved football board game wherein the same utilizes plural pairs of dice for simulating various traverse of an associated playing field.

2. Description of the Prior Art

The prior art includes a variety of board games, wherein play selection is attempted in simulating an experience, such as in a football game. Board games in this category combine some degree of skill in play selection with an associated element of change to provide interest and entertainment in use of the game. A variety of games have utilized playing cards to be randomly drawn to effect movement along a playing field. Examples of such art devices may be found in U.S. Pat. No. 4,773,650 to Doughty setting forth a method of playing a football board game utilizing playing cards and manually positionable series of markers for indication of position along a football field.

U.S. Pat. No. 4,706,959 to Price sets forth a further example of a football game utilizing a variety of cards for directing play along the football field.

U.S. Pat. No. 4,285,521 to Joel, III sets forth a card deck in use with a football field to provide movement along the play in simulation of football play type maneuvers.

U.S. Pat. No. 4,524,975 to Caughie, et al. sets forth a football type board game utilizing dice-like casting solids to represent various plays utilized in the game.

U.S. Pat. No. 4,832,346 to Pierce sets forth a football game organization utilizing various cards in association with a playing field.

As such, it may be appreciated that there continues to be a need for a new and improved football game as set forth by the instant invention wherein the use of selective pairs of dice for selection in providing various strategies in play of an associated football game is set forth.

SUMMARY OF THE INVENTION

In view of the foregoing disadvantages inherent in the known types of football board games now present in the prior art, the present invention provides a football game wherein the same utilizes selection of one of a plurality of dice by opposing players in a football game simulation to determine positioning an direction of opposing teams relative to a simulated football field. As such, the general purpose of the present invention, which will be described subsequently in a greater detail, is to provide a new improved football board game which has all the advantages of the prior art football games and none of the disadvantages.

To attain this, the present invention provides a board game simulating football play, wherein a rigid planar board supports a playing field demarcated in representative one hundred yard simulation defining a first and second end zone at opposed first and second ends of the playing field, with spaced first and second side line borders including slots for receiving slidable yardage markers therewithin. Each player is provided a container including a matrix of compartments therewithin to receive plural pairs of dice. The dice include three pairs of dice, each of various numerations for use in simulating advance along the playing field by an offensive team, with further plural pairs of dice selectively utilized by an opposing player for simulating defensive yardage gains against an opponent. Further, plural paris of dice are provided for use in simulating field goals, kick-offs, and punt returns. A timing mechanism is provided for simulating four quarters of a representative game, wherein a highest score attained by a player defines a winner in play of the game apparatus.

My invention resides not in any one of these features per se, but rather in the particular combination of all of them herein disclosed and claimed and it is distinguished from the prior art in this particular combination of all of its structures for the functions specified.

There has thus been oultined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved football board game which has all the advantages of the prior art football board games and none of the disadvantages.

It is another object of the present invention to provide a new and improved football board game which may be easily and efficiently manufactured and marketed.

It is a further object of the present invention to provide a new and improved football board game which is of a durable and reliable construction.

An even further object of the present invention is to provide a new and improved football board game which is susceptible of a low cost of manufacture with regard to both materials and labor, and which accordingly is then susceptible of low prices of sale of to the consuming public, thereby making such football board games economically available to the buying public.

Still yet another object of the present invention is to provide a new and improved football board game which provides in the appraratuses and methods of the prior art some of the advantages thereof, while simultaneously overcoming some of the disadvantages normally associated therewith.

Still another object of the present invention is to provide a new and improved football board game wherein a heightened element of chance is provided to effect movement about a football field between opposing players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 14 is an isometric illustration of one of a plurality of containers utilized by opponents in play of the instant invention.

FIG. 15 is an isometric illustration of a throwing tray for receiving the dice pair selective therewithin for use with the instant invention.

FIG. 16 is an isometric illustration, taken along the lines 16—16 of FIG. 3, in the direction indicated by the arrows.

FIG. 17 is an isometric illustration of "time out" tokens utilized by the instant invention.

DESCRIPTION OF THE PREFERRED EMBODIMENT

Figure 1:
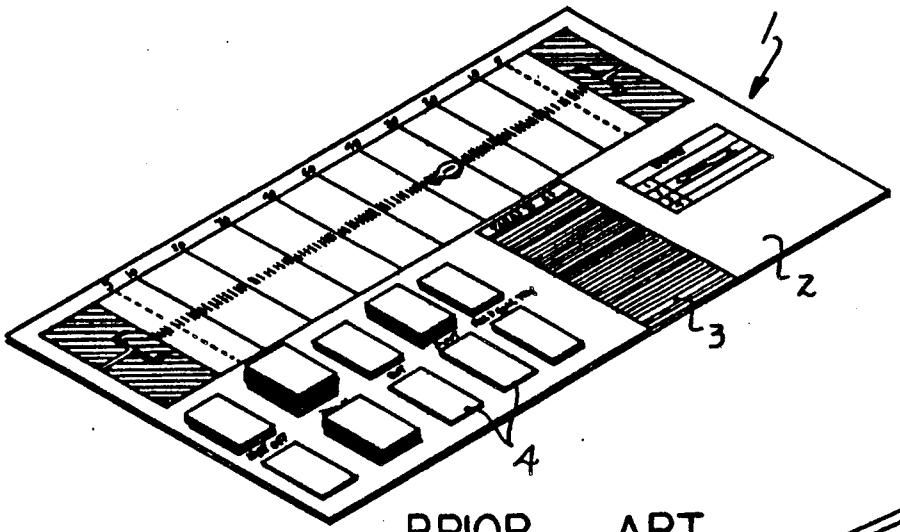
FIG. 1 PRIOR ART
FIG. 1 is an isometric illustration of a prior art football-type board game.

With reference now to the drawings, and in particular to FIGS. 1 to 17 thereof, a new and improved football board game embodying the principles and concepts of the present invention and generally designated by the reference numeral 10 will be described.

Figure 2:
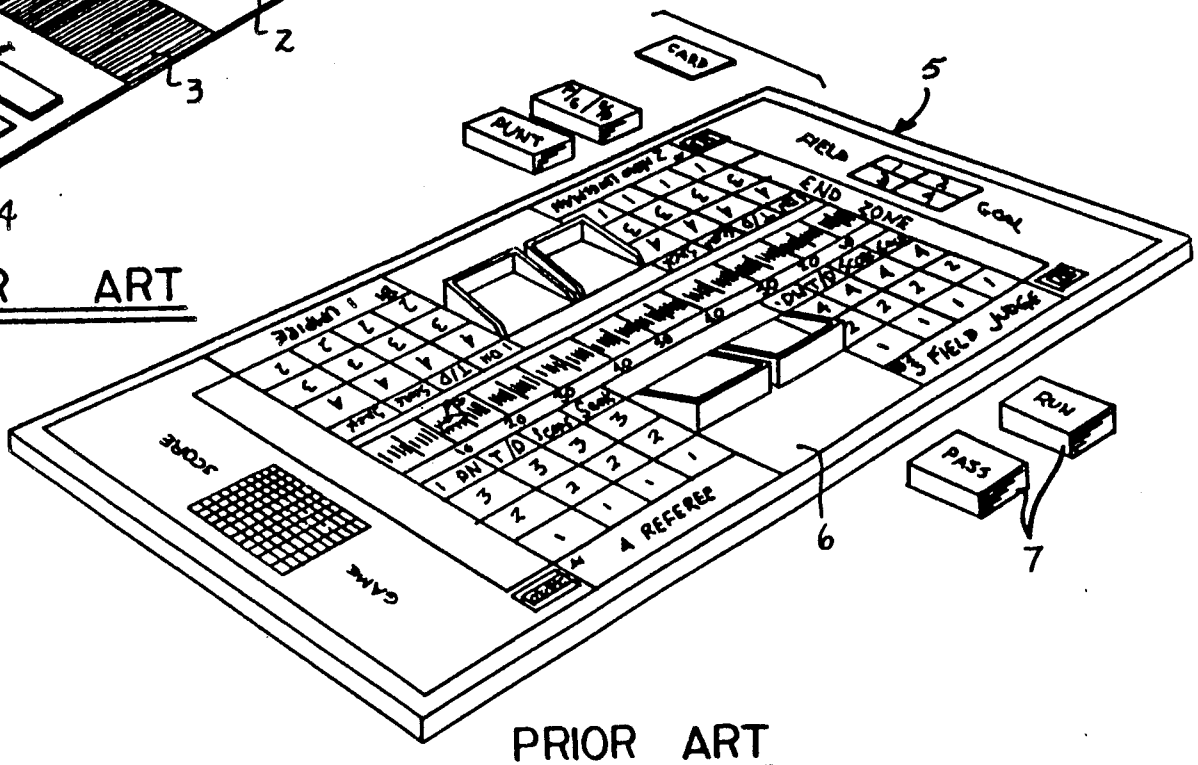
FIG. 2 PRIOR ART
FIG. 2 is an isometric illustration of a further prior art football-type board game.
Figure 3:
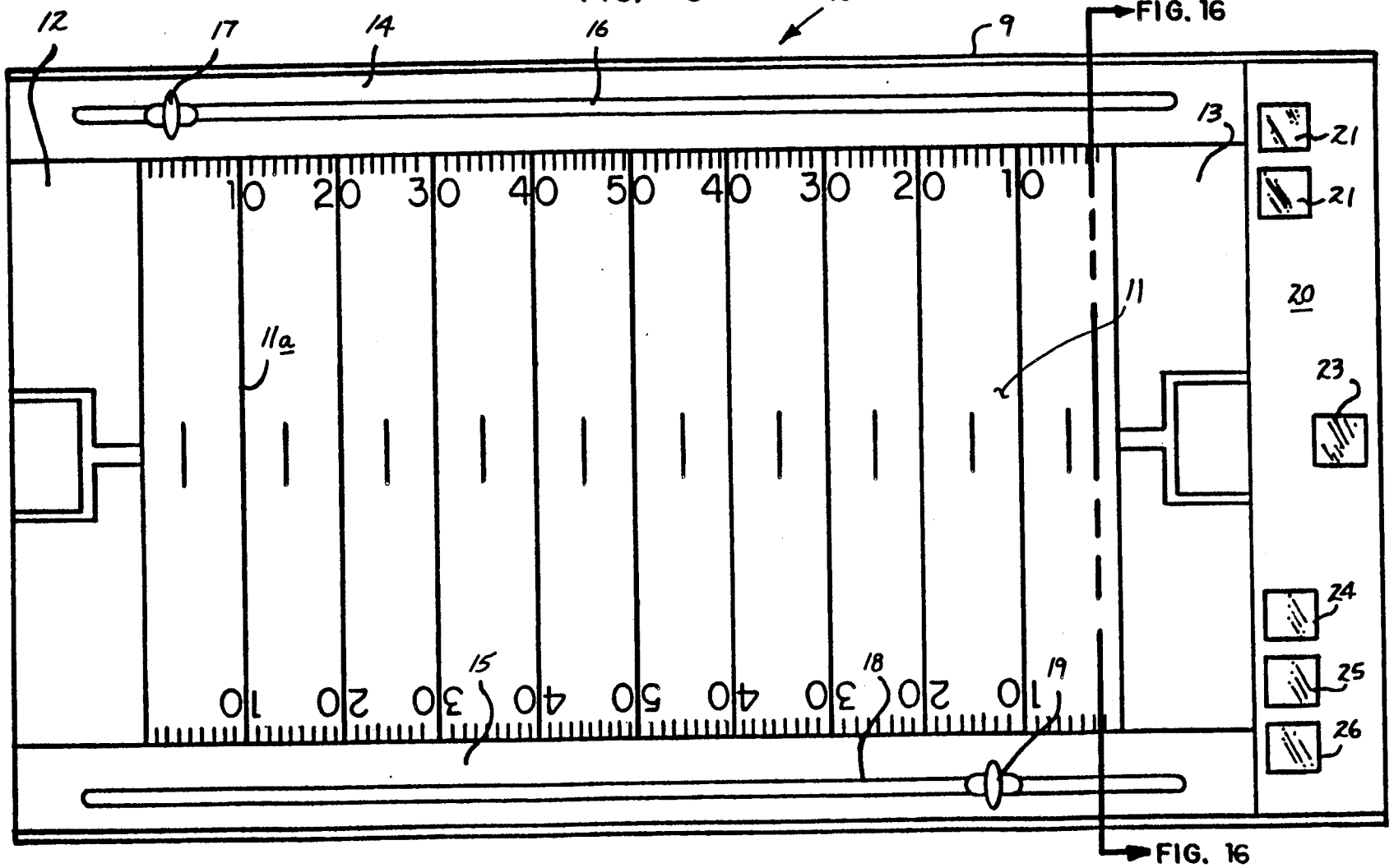
FIG. 3 is a top orthographic view of the instant invention.
Figure 4:
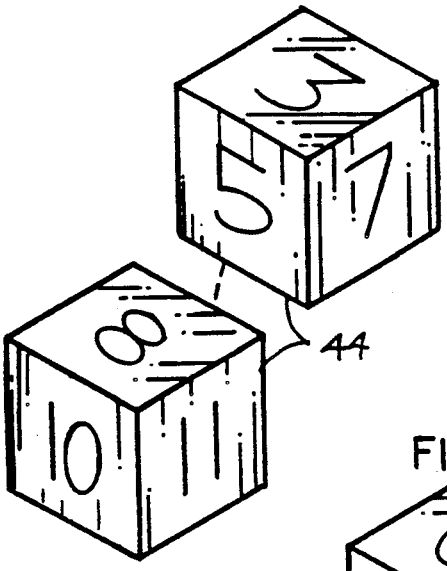
FIG. 4 is an isometric illustration of a first offensive dice pair.
Figure 5:
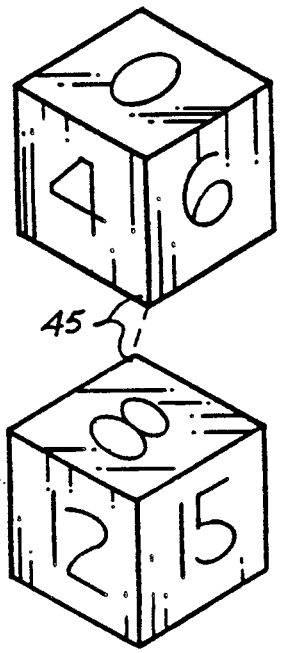
FIG. 5 is an isometric illustration of a second offensive dice pair.
Figure 6:
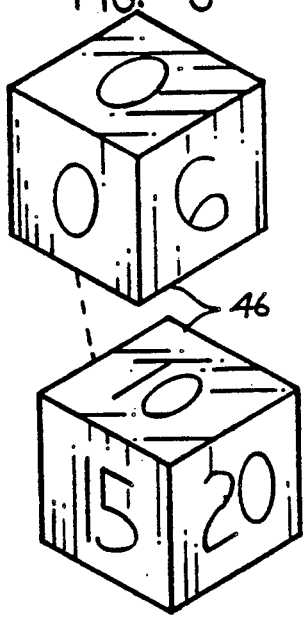
FIG.6 is an isometric illustration of a third offensive dice pair.
Figure 7:
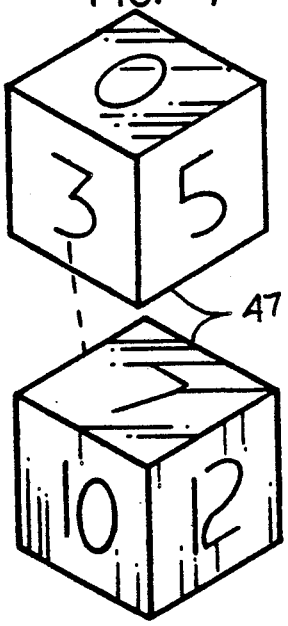
FIG. 7 is an isometric illustration of a first defensive dice pair.
Figure 8:
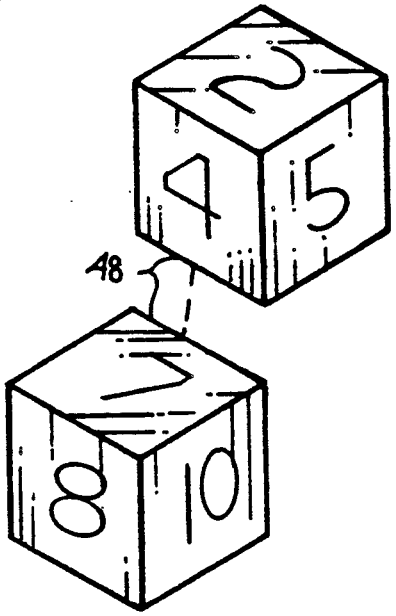
FIG. 8 is an isometric illusration of a second defensive dice pair.
Figure 9:
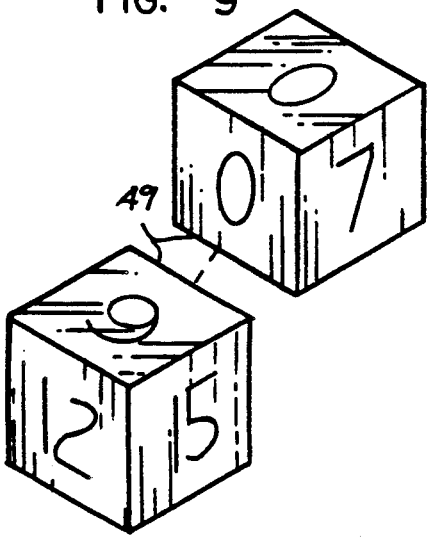
FIG. 9 is an isometric illustration of a third defensive dice pair.
Figure 10:
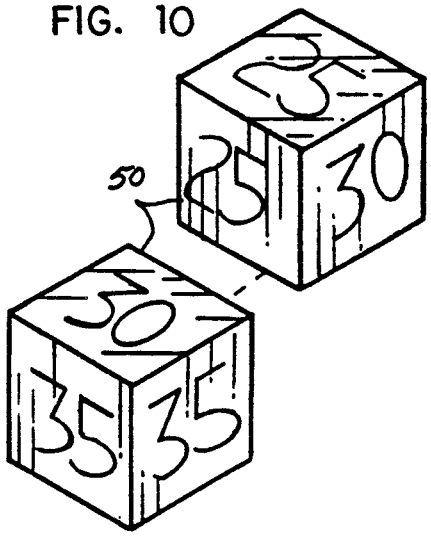
FIG. 10 is an isometric illustration of a kick-off yardage dice pair.

FIG. 1 is an isometric illustration of a prior art football-type board game 1, wherein a board surface 2 includes a yardage accounting portion 3 in association with various cards 4 for directing movement about the playing field of the board game. FIG. 2 illustrates a further prior art football-type board game 5, wherein the board game 6 includes a simulated playing field with a variety of decks of cards 7 to direct play throughout the simulated playing field of the board game.

More specifically, the football board game 10 of the instant invention essentially comprises a rigid board member 9 defining a planar upper surface including a playing field 11 directed over a majority of the surface, with a score board 20 utilized in conventional or LED (light emitting diode) circuitry. The score board 20 is arranged orthogonally at an upper or second end of the playing field adjacent the second end zone border 13. The first end zone border 12 is arranged at an opposed end of the playing field, with the playing field divided to simulate and divide the playing field into representative one hundred one yard increments, including a ten yard line 11*a* arranged orthogonally across the playing field at each representative ten yard increment. A first side line border 14 is arranged coextensively with a first side of the playing field, and a second side line border 15 is arranged at an opposed side line of the playing field coextensively therewith. A first slot 16 is directed coextensively along the playing field with the yard markers, and includes a first yardage marker 17 slidably mounted within the first slot 16 utilizing an indicator for positioning and pointing of first yardage positioning by a first player of the game. Similarly, a second slot 18 is arranged parallel to the playing field as the first slot 16 is coextensive with the one hundred yard demarcations, and includes a second yardage marker 19 with an associated indicator arrow arranged orthogonally relative to the second slot, as the first yardage marker indicator arrows is arranged orthogonally relative to the first slot for indication of an associated yardage position of a respective second player.

The score board 20 includes a first team score button 21 associated with a first team score display 27 for indication of point total of a first team or player. A second team score button 22 is arranged for effecting display of a second team score display 29. A quarter indicator display 22 indicates a particular quarter of play, (i.e. one through four) and utilizes an associated quarter indicator display button 28*a* for effecting display of a first through fourth quarter. A reset button 23 directs a time indicator screen 30 to reset to a fifteen minute interval in association with each quarter of play, wherein each quarter of play is directed at fifteen minutes. An offensive play button 24 is provided that is depressed with each offensive play of an associated game to remove twenty-five seconds from the fifteen minute display of the time indicator screen 30, wherein the offensive play button 24 is depressed prior to commencement of an offensive play by one of the players in an offensive mode directing play towards an opposing goal. A punt and field goal button 25 is depressed prior to a punt or field goal being initiated within the playing of the game and removes ten seconds from the time indicator screen 30. A time-out button 26 when depressed removes five seconds from the time indicator screen 30. Each player is at the outset of the game awarded three time-out tokens 43 (see FIG. 17) and each player may utilize up to there tokens during each half, or consecutive two quarters of play (i.e. quarters one and two, or quarters three and four). The time-out tokens are utilized to minimize usage of playing time during play of the game for associated simulation of a real football game scenario.

Figure 11:
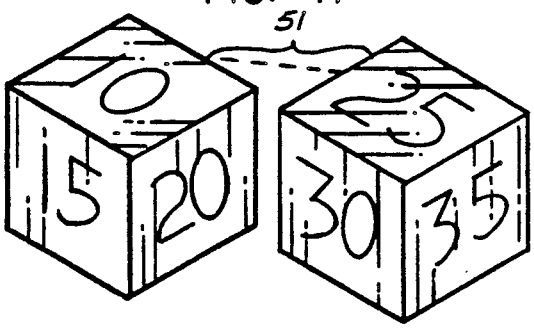
FIG. 11 is an isometric illustration of a punt yardage dice pair.
Figure 12:
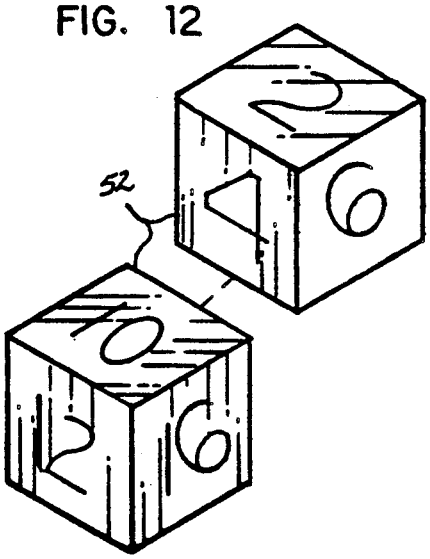
FIG. 12 is an isometric illustration of a return yardage dice pair.
Figure 13:
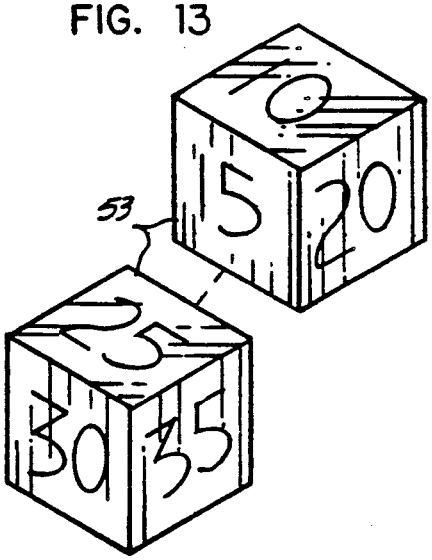
FIG. 13 is an isometric illustration of a field goal yardage dice pair.

Each player is provided a compartmentalized player container 31 including a matrix of compartments therewithin. Particularly, twelve compartments are provided. Three offensive die pair compartments 32 of the twelve compartments include three separate die pair for use in directing offensive play throughout a game. Three defensive die pair compartments 33 each include a defensive die pair. The offensive and defensive die pairs are illustrated in FIGS. 4–9 respectively, with FIGS. 4–6 indicating the use and indicia utilized by the three individual die pairs, wherein FIGS. 7–9 indicate the use of the three individual die pairs for defensive play. Compartment 34 includes a kick-off die pair compartment illustrated in FIG. 10. FIG. 11 illustrates a punt die pair for positioning within a punt die pair compartment 35. A kick return die pair 36 compartment is provided for reception of a die pair, as illustrated in FIG. 12, and a field goal die pair compartment 37 receives a die pair, as illustrated in FIG. 13. Further, a chance die compartment 38 is provided for optional play by an individual when two players are not available. The chance die (not illustrated) is provided to direct use of one of the three respective offensive and defensive die pair 44–46 and 47–49. The chance die pair would for example be a six-sided die in a manner as the remainder of the die, and include two number ones, two number twos, and two number threes for indication of use of a respective first, second, or third associated offensive or defensive die pair. Each player container 31 includes a lid 40 hingedly mounted about a pivot hinge 41 to obscure vision of die pair selection from an opposing player, whereupon a defensive player selection of an associated die pair 47–49 is not dependent upon visual observation of the opposing defensive die selection 44–46. Each player is provided a throwing tray 42, as illustrated in FIG. 15 for example, wherein the throwing tray 42 includes vertical walls in surrounding relationship to a floor, wherein the die pair are directed to permit directing the die pair onto the playing field to inadvertently impact with a respective first or second yardage marker 17 or 19, or impact with an opposing player's die and thereby contain movement of the thrown die pair within the associated throwing 42.

The first offensive die pair 44 each include the digits three, five, seven, eight, ten, and eleven. Each die of the second offensive die pair 45 each include the digits zero, four, six, eight, twelve, and fifteen. Each die of the third offensive die pair 46 include the digits zero, zero, six, ten, fifteen, and twenty. Each die of the first defensive die pair 48 include the digits two, four, five, seven, eight, and ten. Each die of the second defensive die pair 47 include the digits zero, three, five, seven, ten, and twelve. Each die of the third defensive die pair 49 include the digits zero, zero, seven, nine, twelve, and fifteen. It is noted that the die pair of the offensive and defensive die pair with the largest digits, i.e. die pair three of the offensive and defensive die pairs, also include the greater number of zeros, wherein the die pair including digits of a medial range such as the first die pair of each offensive and defensive die pair ensure a medial total and thereby ensure a simulated yard total for offensive and defensive player while not providing a greater potential yardage total when a player risks the zero digits of the second and third die pair of the offensive and defensive die pair.

In a similar manner, the kick-off yardage die pair 50 indicates a total yardage by a player in a kick-off position, wherein each die of the kick-off yardage die pair include the numbers twenty-five, twenty-five, thirty, thirty, thirty-five, and thirty-five. Accordingly, a total kick-off yardage will range from fifty to seventy yards. The punt yardage die pair 51 each include a die including the digits ten, fifteen, twenty, twenty-five, thirty, and thirty-five. The return yardage die pair 52 include die each including the digits two, four, six, ten, twelve, and sixteen. The die pair 44–52 accordingly indicate a total yardage to be awarded. The field goal die pair 53 each include a die with the digits ten, fifteen, twenty, twenty-five, thirty, and thirty-five.

Use of the die pairs 44–53 are exemplified as follows:

A coin is tossed by one player of the opposing first and second players, whereupon in this example, the second player chooses and a correct choice by the second player affords that player the opportunity of choosing an offensive or defense posture in initiating play of the game. Accordingly, the kicking team or offensive mode of a player, initiates play from their own thirty-five yard line along the playing field. The second player for example then will roll the kick-off die pair 50 to determine how far the ball will be directed along the playing field. For example, should the second player roll a thirty on one die and a thirty on the other die, a total of sixty yards is directed. The opposing player at that juncture rolls the return yardage die pair 52, where for example a six and a sixteen may be rolled, whereupon twenty-two yards is substracted from the sixty yards. Alternatively, the kicking player directs the kicked ball to the opposing player's five yard line, whereupon the twenty-two yards directed by the return yardage die pair 52 (i.e. twenty-two yards) is added to the five yard line, whereupon play is begun at yhe twenty-seven yard line.

Accordingly, the offensive player begins with a first down and a ten at the twenty-seven yard line. The kick-offs take ten seconds from the clock so the time remaining in the first quarter will be fourteen minutes and fifty seconds. The offensive player selects a number three offensive, or the third offensive die pair 46. The defensive player selects the number three defensive or the third defensive die pair 49. The offensive player rolls a six and a twenty for twenty-six, wherein the defensive playe rolls a seven and a nine for sixteen. Accordingly, sixteen yards is deducted from twenty-six yards for a net gain of ten yards by the offensive player to the thirty-seven yard line for a first down. This sequence is repeated until an offensive player attains a touchdown or is directed to punt the ball or kick the field goal.

In attempting a punt, the offensive player for example may have the ball on a fourth down and one yard to go at the forty-six yard line. In deciding to punt, the offensive team directs the punt yardage die pair 51 into an associated throwing tray 42, wherein for example, when 5 labeling FIG. 15 missing a punt is attempted a 20 and 25 are rolled equaling 45 wherein 45 yards from the player's own 46 leaves the ball on the nine yard line. The return team rolls a 10 and 12 equaling 22 and moves the ball to the 31 yard line to effect a first down and ten yards to go. It should be noted that if the punt had traversed into the end zone, the new offensive player could have either put the fictitious ball at his own twenty yard line as an alternative to throwing the return yardage die pair 52. A punt and a return each deduct five seconds from the time indicator screen 30.

To attempt a field goal, if an offensive team for example positions the ball at the twenty-three yard line of an opposing player and decides to attempt a field goal, the field goal die pair 53 are directed into the throwing tray 42 and for example may obtain a fifteen and twenty-five to equal forty. The field goal or three points is awarded that player. In a field goal scenario, ten yards is added to the position of the offensive team, wherein accordingly the ball by the example being on the twenty-three yard line with ten yards added requires a total of thirty-three or greater, whereupon the aforenoted example of forty being obtained provides for an acceptable field goal attempt. Should the point total have been less than thirty-three, the field goal would not have been awarded.

It is contemplated that contrasting colors be awarded each opposing team for ease of recognition of various die pair and yardage markers utilized. Accordingly, a color coordination could be set forth such as black and yellow for a first team and red and white for an opposing team as an example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game apparatus for use by a plurality of opposing players for simulating a football game, wherein the apparatus comprises, a planar game board, including first indicia defining a football field, wherein the football field further includes second indicia to define simulated ten yard designations at equal predetermined spacings along the football field, and a forward and rear end of the football field including a forward and rear goal line respectively, and further including a left side line border and a right side line border, the left side line border including a first slot coextensive with the football field, and the right side line border including a second slot coextensive with the football field, wherein the first and second slots are parallel relative to one another, and a first yardage marker slidably mounted within the first slot, and a second side line marker mounted within the second slot, wherein the first and second side line markers are utilized by the respective opposing players for indication of relative positioning of the respective positioning of the opposing players on the football field, and a score board member orthogonally mounted relative to the football field in a spaced relationship relative to the football field, and a plurality of dice pair, wherein each pair of the plurality of dice pairs are defined by a distinct array of digits relative to opposing dice pair for indication of relative movement of the opposing players about the football field said plurality of dice pairs include, a first offensive dice pair and a first defensive dice pair, each die of said first offensive and defensive dice pairs having digits of a medial range for representing football plays resulting in total yardage movements of medial range, a second offensive dice pair and a second defensive dice pair, each die of said second offensive and defensive dice pairs having digits of greater range than said first offensive and defensive dice pairs for representing football plays resulting in total yardage movements potentially smaller than the smallest total yardage movement obtainable by said first offensive and defensive dice pairs and total yardage movements potentially larger than the largest total yardage movement obtainable by said first offensive and defensive dice pairs, a third offensive dice pair and a third defensive dice pair, each die of said third offensive and defensive dice pairs having digits of greater range than said second offensive and defensive dice pairs for representing football plays resulting in total yardage movements potentially smaller than the smallest total yardage movement obtainable by said first offensive and defensive dice pairs and total yardage movements potentially larger than the largest total yardage movement obtainable by said second offensive and defensive dice pairs; a kick-off yardage dice pair; a punt yardage dice pair; a return yardage dice pair; and a field goal dice pair, wherein each die of each dice pair is defined by six-sided dice.

2. An apparatus as set forth in claim 1 including a compartmentalized player container provided, and each container includes twelve compartments, each of the twelve compartments accommodates a dice pair, and further accommodates one of said yardage markers, and provides a further compartment for accommodating a dice member.

3. An apparatus as set forth in claim 2 wherein each container further includes a lid, each lid including a hinge pivotally mounting each lid to each respective container to obscure visual observation of the compartments of each container by an opposing player.

4. An apparatus as set forth in claim 3 wherein the score board member includes a first team score dispaly and a second team score display, and a first button for effecting adjustment of the first team score display, and a second button for effecting adjustment of the second team score display, and a timer screen for indicating remaining time within a football period, and a timer button for resetting the timer screen.

5. An apparatus as set forth in claim 4 wherein the score board member further includes a play button to remove twenty-five seconds from the timer screen, and a punt button for removing ten seconds from the time screen.

* * * * *